US006290555B1

(12) United States Patent
Nubuyuki et al.

(10) Patent No.: US 6,290,555 B1
(45) Date of Patent: Sep. 18, 2001

(54) HOUSING TO PREVENT WICKING OF MOLTEN SOLDER AND FLUX

(75) Inventors: Hasengawa Nubuyuki, Sagamihara (JP); Mu-An Yen, Lu-Chou; Min-Fang Wu, Tu-Chen, both of (TW); Giang Yu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/547,985

(22) Filed: Apr. 12, 2000

(51) Int. Cl.[7] ..... H01R 4/02
(52) U.S. Cl. ..... 439/876
(58) Field of Search ..... 439/83, 876, 733.1

(56) References Cited

U.S. PATENT DOCUMENTS 4,857,001 * 8/1989 Nakano et al. ..... 439/733.1
5,692,920 * 12/1997 Banakis et al. ..... 439/876
5,934,951 * 10/1999 Lai et al. ..... 439/876
5,947,778 * 8/1989 Lai et al. ..... 439/876

* cited by examiner

*Primary Examiner*—Gary F. Paumen
(74) *Attorney, Agent, or Firm*—Wei Te Chung

(57) ABSTRACT

An electrical connector of the present invention comprises an insulative housing defining a plurality of contact receiving holes for receiving corresponding contacts. The housing forms a protrusion laterally extending into each contact receiving hole from a bottom of an inner wall thereof. Each contact includes an upper contacting section for engaging with a mating lead pin of a chip, a middle fixing section located below the upper contacting section for having an interferential fit with the housing, and a lower inserting section for being soldered to a printed circuit board. The fixing section has an embossment for engaging with the protrusion of the housing to sealingly separate the lower inserting section from the upper contacting section so that solder and flux is prevented from wicking upward to contaminate the upper contacting section when soldering the lower inserting section to the printed circuit board.

1 Claim, 5 Drawing Sheets

HOUSING TO PREVENT WICKING OF MOLTEN SOLDER AND FLUX

BACKGROUND OF THE INVENTION

1. Field of the Invention

The present invention relates to a connector, and particularly to a connector having improved housing and contacts to prevent molten solder and flux from wicking into the housing when soldering.

2. The Prior Art

FIG. 5 shows a conventional bottom-loading contact 4 received in a bottom-loading contact receiving hole 50 of a conventional insulative housing 5. For facilitating the insertion of the contact into the contact receiving hole 50 of the housing 5, the dimension of the hole 50 is usually relatively large. This leaves a relatively large gap T remaining between the contact and the inner walls of the hole, which allows wicking of molten solder and flux into the contact receiving hole and resultant contamination of the contact during wave soldering. Hence, an improved electrical connector is required to overcome the disadvantages of the prior art. U.S. Pat. Nos. 5,934,951 and 5,947,778 disclose some approaches to cure this problem. Anyhow, an easy and economic way is still desired to efficiently cure this problem.

BRIEF SUMMARY OF THE INVENTION

An object of the present invention is to provide an improved housing and contacts of an electrical connector to prevent the wicking of molten solder and flux into the housing when soldering.

The connector comprises a plurality of contacts and an insulative housing defining a plurality of contact receiving holes for receiving the corresponding contacts. Each contact includes an upper contacting section having a deflected lateral end, a middle fixing section having an embossment on a central portion thereof and barbs on both lateral sides thereof for interferingly fitting with inner walls of the contact receiving hole, and a lower inserting section. Each contact receiving hole forms a protrusion extending laterally a sufficient distance from a bottom of an inner wall of the contact receiving hole toward the fixing section of the contact to reduce the size of a gap between the fixing section and the inner wall of the contact receiving hole. The protrusion defines a vertical face at an upper portion thereof for cooperating with the embossment of the contact to seal the gap, thus preventing molten solder and flux from wicking into the contact receiving hole and contaminating the upper contacting section when soldering the contacts to a printed circuit board. A slope at a bottom portion of the protrusion facilitates the insertion of the contacts into the contact receiving holes.

Other objects, advantages and novel features of the invention will become more apparent from the following detailed description of the present embodiment when taken in conjunction with the accompanying drawings.

DETAILED DESCRIPTION OF THE INVENTION

Figure 1:
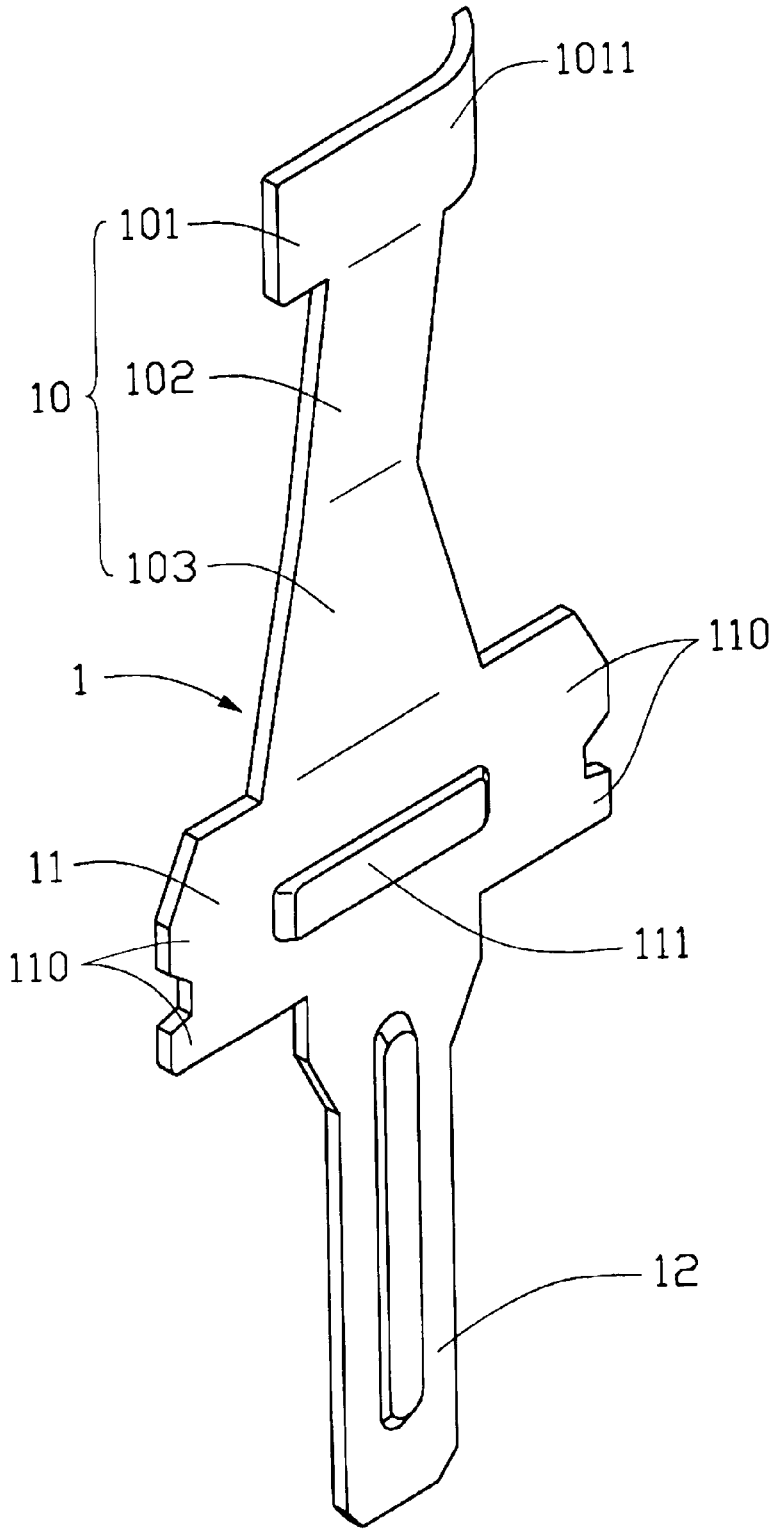
FIG. 1 is a perspective view of a contact in accordance with the present invention.
Figure 2:
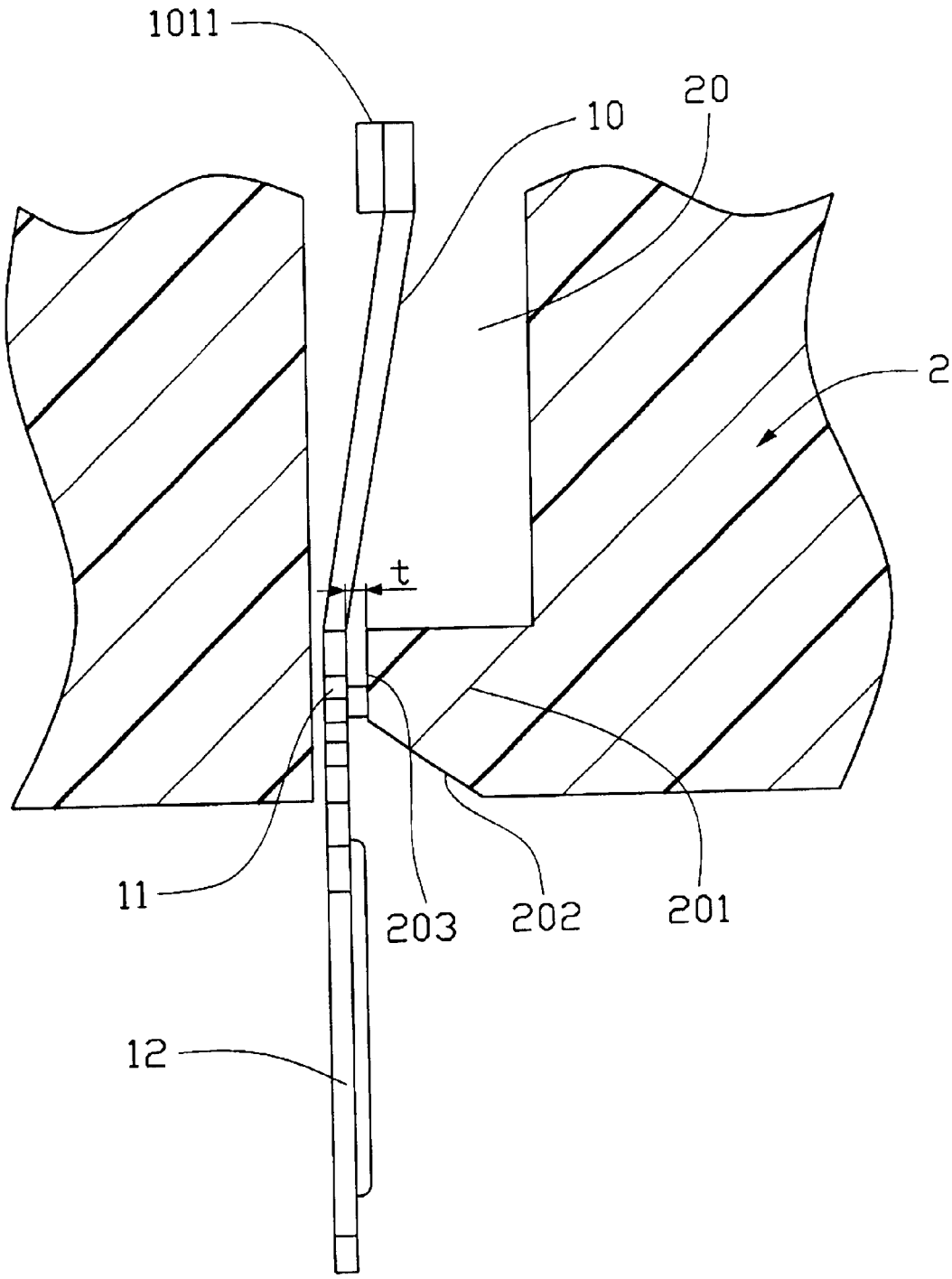
FIG. 2 is a cross-sectional view showing an assembly of the contact and a housing of the present invention.

A contact 1 and an insulative housing 2 in according with the present invention are shown in FIGS. 1 and 2. The contact 1 comprises a lower inserting section 12 for inserting into a printed circuit board (not shown), an upper contacting section 10 for engaging a mating lead pin of a chip (not shown), and a middle fixing section 11 for fixing in the housing 2. The upper contacting section 10 includes a contacting portion 101 for mating with the mating lead pin of the chip, a neck portion 102 extending downward from a lower edge of the contacting portion 101, and a transition portion 103 extending downward from a lower edge of the neck portion 102 for transitioning into the middle fixing section 11. The contacting portion 101 is wider than the neck portion 102 and comprises a deflected lateral end 1011 for guiding an entrance of the mating leading pin of the chip to engage with the contacting portion 101. The neck portion 102 is substantially an elongate plate which serves as a spring piece for the contacting portion 101. The transition portion 103 has a width increasing gradually from an upper portion to a lower portion and thus provides a strong connection to the middle fixing section 11. The neck portion 102 and transition portion 103 incline relative to the contacting portion 101 and fixing section 11 to provide resilience for fixedly connecting the contacting portion 101 with the mating lead pin of the chip. The fixing section 11 includes barbs 110 on both lateral edges thereof, and an embossment 111 stamped on a central portion (not labeled) thereof. The embossment 111 protrudes from a face (not labeled) of fixing section 11.

Figure 5:
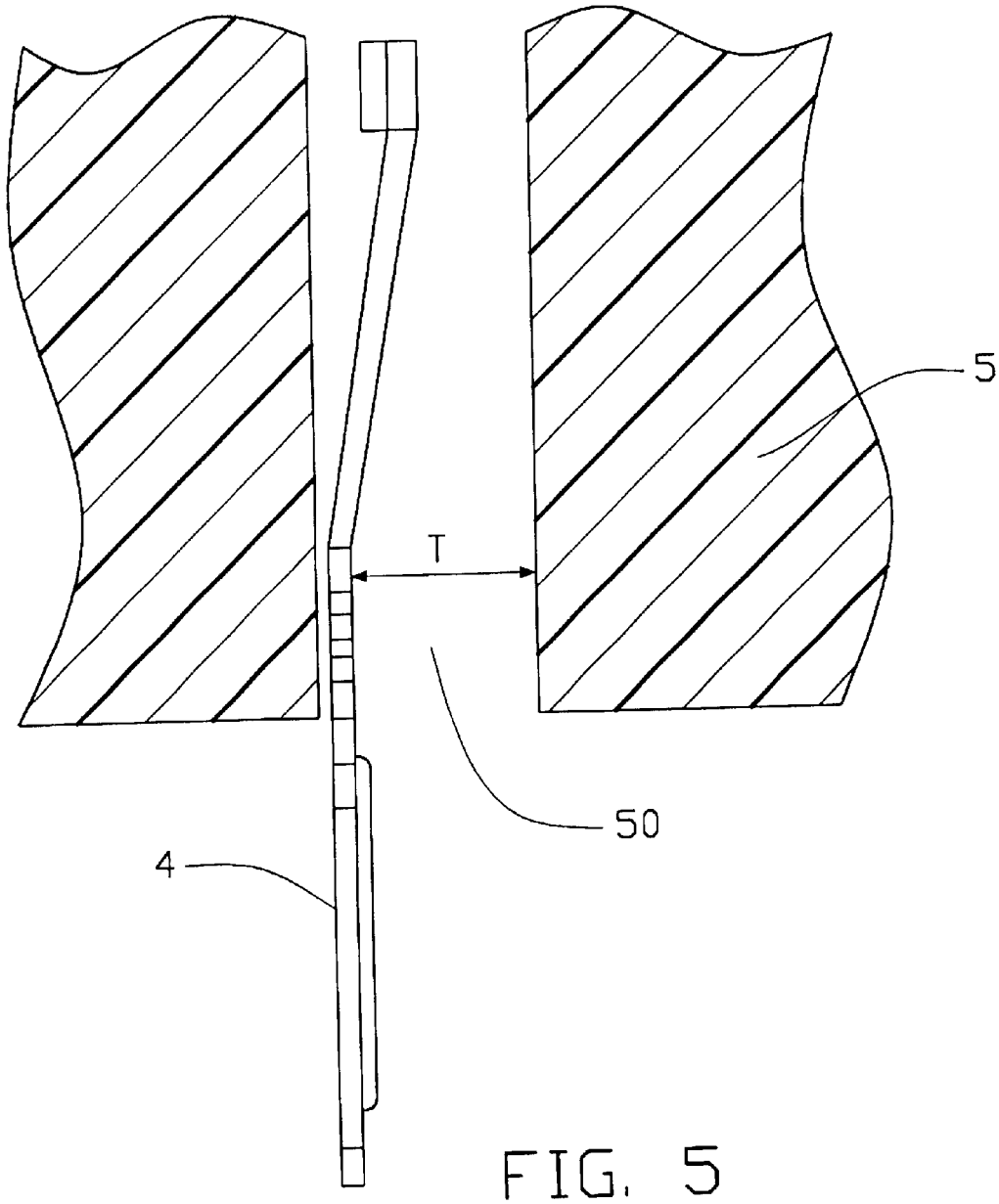
FIG. 5 (PRIOR ART)
FIG. 5 shows an assembly of a conventional contact and housing.

The housing 2 including a plurality of contact receiving holes 20 for receiving corresponding contacts 1. FIG. 2 shows a contact fixed in a contact receiving hole 20. The housing 2 forms a protrusion 201 which extends laterally from a bottom of an inner wall of each contact receiving hole 20 into the contact receiving hole 20, producing a gap between the protrusion 201 and the fixing section 11 of a contact inserted into the housing 2, the gap having a width t. The gap width t is much smaller than the width T between an inner wall of prior art contact receiving hole and a contact as shown in FIG. 5. The protrusion 201 defines a vertical face 203 at an upper portion thereof for cooperating with the embossment 111 of the contact 1 to seal the gap t thereby to efficiently prevent molten solder and flux from wicking into the contact receiving hole 20 and contaminating the upper contacting section 10 when soldering the contacts 1 to a printed circuit board (not shown). A slope 202 is formed by the protrusion 201 declining from a bottom of the vertical face 203 to a bottom face of the housing 2 for facilitating insertion of the contact 1 into the contact receiving hole 20.

Figure 3:
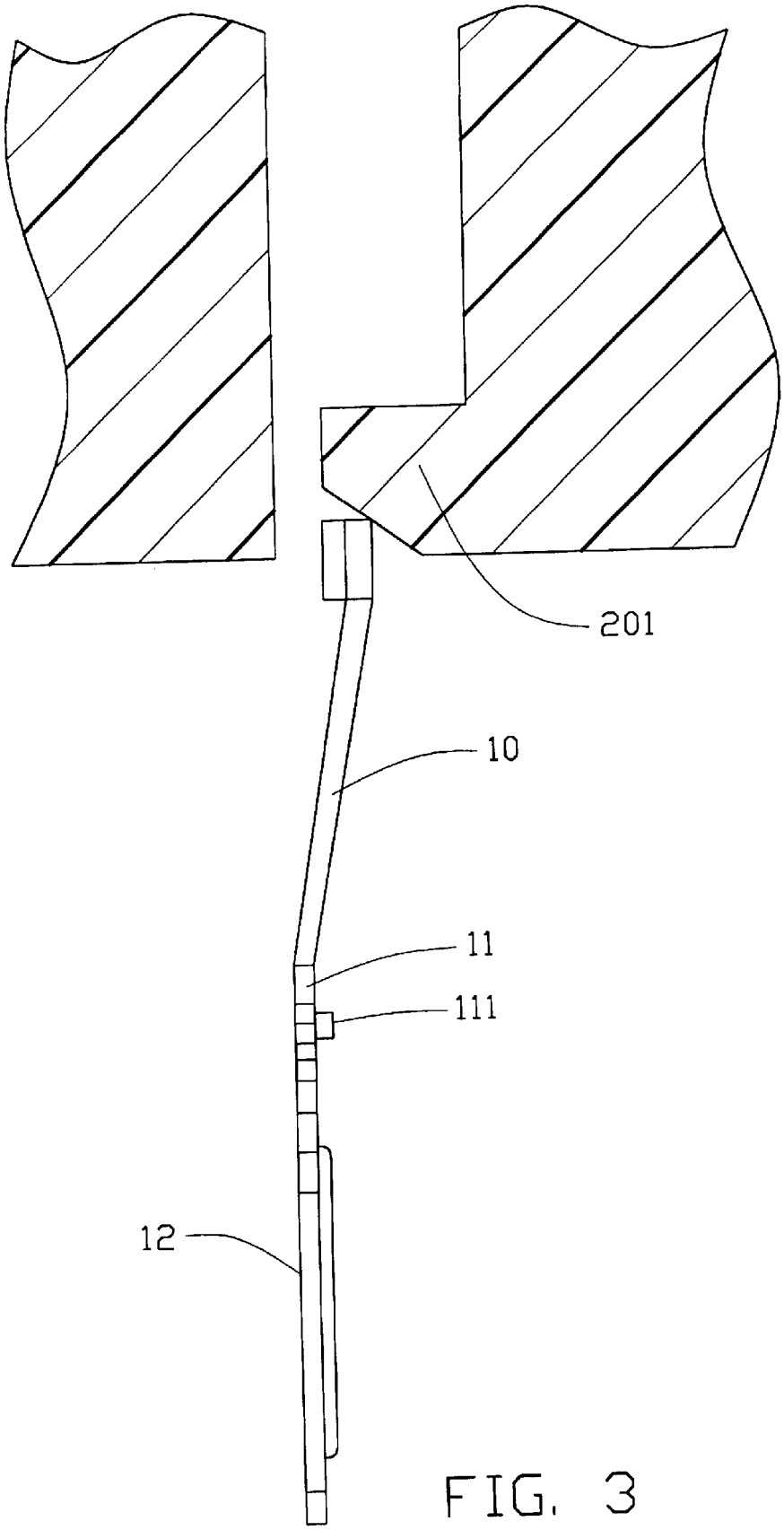
FIG. 3 is a view similar to FIG. 2 showing a first pre-assembled condition of the contact as it starts to be inserted into the housing.
Figure 4:
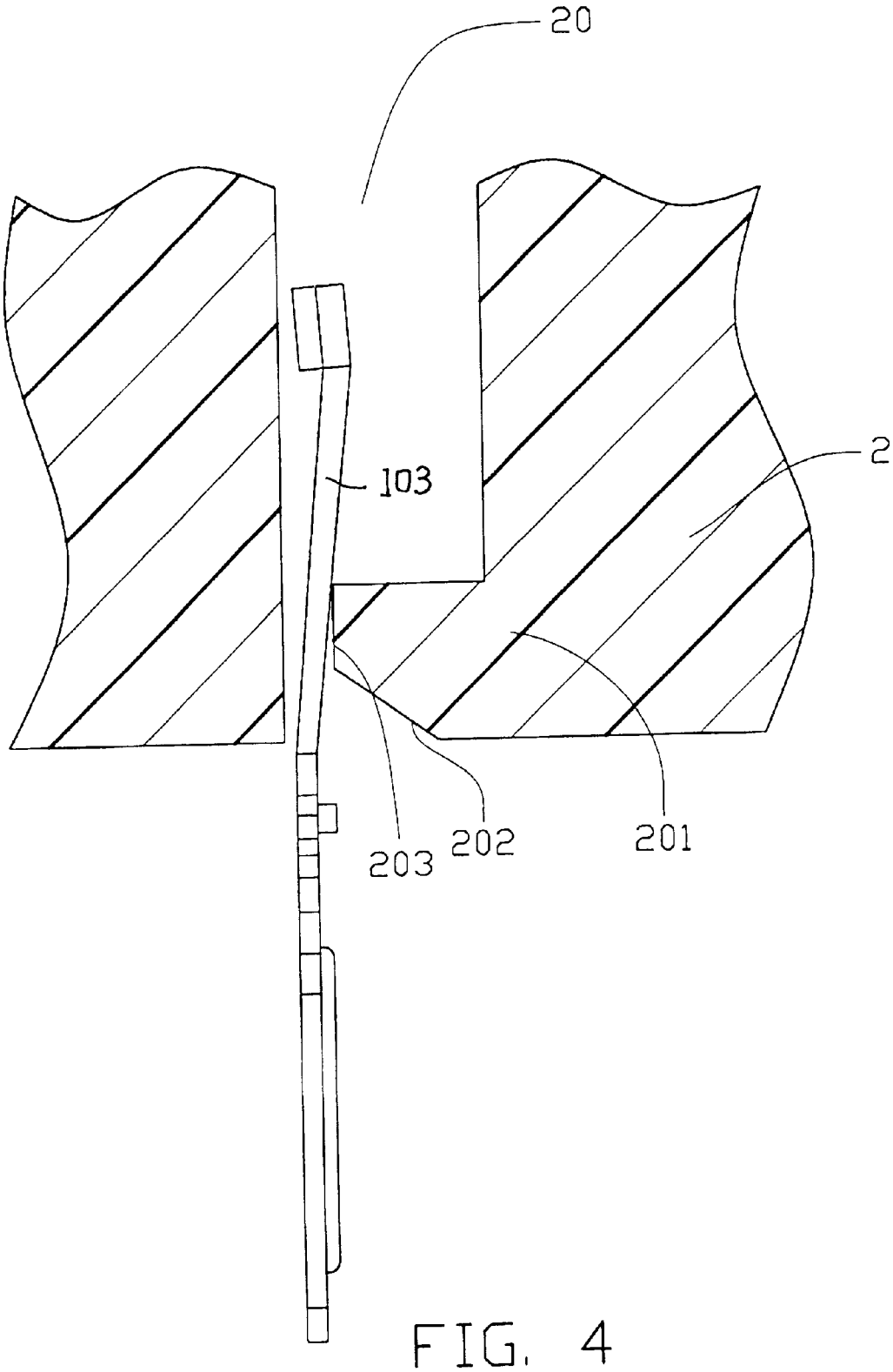
FIG. 4 is a view similar to FIG. 2 showing a second pre-assembled condition of the contact wherein the contact is partly inserted into the housing.

To assemble a contact 1 in the housing 2, firstly, the contact 1 is brought to a position in which the contacting portion 101 is in contact with the slope 202, as shown in FIG. 3. The contact 1 is then pushed upwardly so that the contacting portion 101 slides along the slope 202 and the upper contacting section 10 is deformed to reach a position wherein the contacting portion 101 passes through a passageway (not labeled) between the protrusion 201 and the opposing wall to enter the contact receiving hole 20 and the transition portion 103 is deformably, in a deflection manner, extended through the passageway, as shown in FIG, 4. Finally, the contact 1 is further pushed upwardly to reach a final assembled position as shown in FIG. 2, in which the barbs 110 of the fixing section 11 have an interferential fit with the housing 1, the embossment 111 engages with the vertical face 203 to substantially sealingly separate the upper contacting section 10 from the lower inserting section 12 of the contact 1. Thus, the molten solder and flux are prevented from wicking upwardly to contaminate the upper contacting section 10 when soldering the contact 1 to the printed circuit board. At the final assembled position, the upper contacting section 10 resumes the original shape it had before insertion into the housing, in a free manner.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining contact receiving holes;

contacts each having an upper contacting section for engaging with a mating lead pin of a chip and providing a spring force for ensuring a reliable engagement between the upper contacting section and the mating lead pin of the chip, said upper contacting section being received in the corresponding contact receiving hole, a fixing section located below the upper contacting section and having an interferential fit with the housing, and a lower inserting section located below the fixing section for being soldered to a printed circuit board;

said fixing section having an embossment engaging with a protrusion near a bottom portion of the housing projecting into the contact receiving hole to sealingly separate the lower inserting section from the upper contacting section so that solder/flux is prevented from wicking upward to contaminate the upper contacting section when soldering the lower inserting section to the printed circuit board;

wherein the upper contact section includes a contacting portion having a deflected lateral end for guiding the entrance of a mating lead pin of a chip, a neck portion and a transition portion;

wherein the neck portion and the transition portion inclined relative to the contacting portion and the fixing section for providing resilience;

wherein the protrusion includes a vertical face engaging with the embossment of the contact and a slope for facilitating insertion of the contact into the contact receiving hole of the housing;

wherein the contacts are upwardly inserted into the contact receiving holes from the bottom portion of the housing;

wherein a slope is formed on an undersurface of each protrusion for deflecting the contacts when the contacts are upwardly inserted into the contact receiving holes from the bottom portion of the housing.

* * * * *